United States Patent [19]

Kirsch

[11] 4,139,833

[45] Feb. 13, 1979

[54] RESISTANCE TEMPERATURE SENSOR

[75] Inventor: Thomas S. Kirsch, Oxnard, Calif.

[73] Assignee: Gould Inc., Oxnard, Calif.

[21] Appl. No.: 743,706

[22] Filed: Nov. 22, 1976

[51] Int. Cl.[2] ..... H01C 7/00; H01C 1/012

[52] U.S. Cl. ..... 338/308; 29/612; 29/620; 338/25; 338/329; 427/124

[58] Field of Search ..... 338/307, 308, 329, 25, 338/22; 73/362 AR; 29/612, 620; 427/123, 124, 125, 103

[56] References Cited

U.S. PATENT DOCUMENTS 3,478,191 11/1969 Johnson et al. ..... 219/543 X 3,607,386 10/1971 Galla et al. ..... 29/620 X 3,845,443 10/1974 Fisher ..... 338/25

*Primary Examiner*—C. L. Albritton

*Attorney, Agent, or Firm*—George J. Netter; Eber J. Hyde; Charles E. Snee, III

[57] ABSTRACT

A polished ceramic substrate is provided with an insulation layer of silicon monoxide (SiO), over which a nickel metal thin-film is laid down in a spiral or serpentine pattern, taking up a desirably small area, but at the same time giving a high electrical resistance. Finally, a cover or protective layer of silicon monoxide is then deposited over the resistor, serving to protect it from the possibility of outside contamination.

3 Claims, 3 Drawing Figures

FIG. 1.
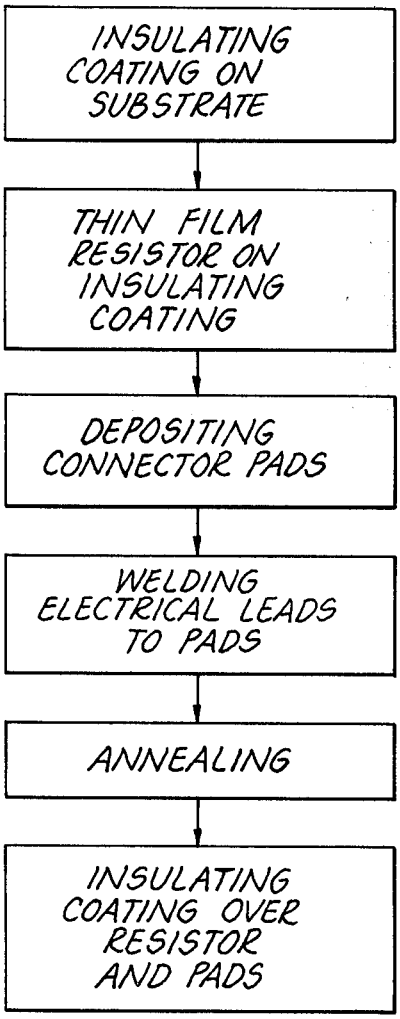
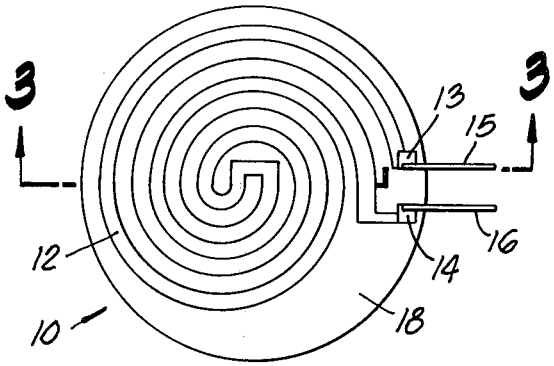
FIG. 2.
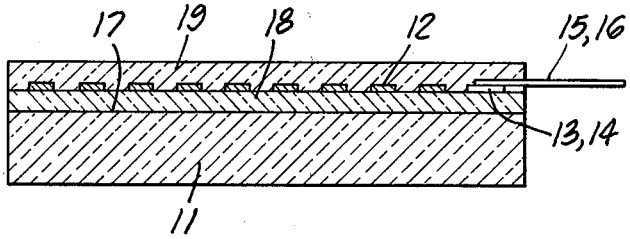
FIG. 3.

RESISTANCE TEMPERATURE SENSOR

BACKGROUND OF THE INVENTION

1. Field of the Invention

The present invention relates generally to temperature sensors, and, in particular, to a thin-film deposited temperature sensor.

2. Description of the Prior Art

The most commonly used resistance thermometer at the present time includes a sensor constructed of a wire coil, the resistance of which changes in a predetermined known manner as a function of temperature. These wire coils have been made of nickel, platinum, tungsten, nicrome (an alloy of nickel and chromium) and other materials having a suitably high temperature coefficient of resistivity (TCR). To achieve the requisite high degree of accuracy with such a wire sensor, the material must have high electrical resistance which, in turn, necessitates the use of a relatively long length of wire of small diameter. The reason for this is a high resistance sensor has correspondingly high change of resistance for a change of temperature, and, therefore, is more easily calibrated than a low resistance sensor would be. In addition, a wire coil can only be loosely supported on an insulating substrate and must be annealed in order to obtain a predictable and repeatable resistance. All of these requirements result in the wire coil being relatively fragile and susceptible to breakage from vibrations, shock, and, as well, contamination from external materials.

On the other hand, thin-film temperature sensors can be constructed having very high resistance and at the same time be exceptionally rugged and not readily damaged by normally occurring external circumstances. In addition, thin-film temperature sensors may be deposited on very small substrates providing an improved advantage with respect to size, weight and response time over coil sensors. Still further, shocks and vibrations do not affect deposited film resistors since the substrate is relatively rigid and the resistor may be coated, making it substantially immune to contamination from the outside.

SUMMARY OF THE INVENTION

In accordance with the practice of this invention, a polished ceramic substrate is provided with an insulation layer of silicon monoxide (SiO). A nickel metal thin-film is then laid down onto the insulation layer in a helical or serpentine pattern taking up a desirably small area, but at the same time giving a high electrical resistance. Finally, a cover or protective layer of silicon monoxide is then deposited over the resistor serving to protect it from the possibility of outside contamination.

BRIEF DESCRIPTION OF THE DRAWING

FIG. 1 is a block diagram of the method for making the thin-film resistor temperature sensor of this invention.

FIG. 2 is a plan view of the temperature sensor.

FIG. 3 is an elevational, sectional view taken along the line 3—3 of FIG. 2.

DESCRIPTION OF A PREFERRED EMBODIMENT

With reference now to the drawings and in particular to FIGS. 2 and 3, the temperature sensor of this invention is enumerated generally as at 10, and is seen to include a base or substrate 11 on a surface on which there is arranged a serpentine resistor 12, the ends of which connecter pads 13 and 14 are interconnected with external apparatus (not shown), via leads 15 and 16. More particularly, and as best shown in FIG. 3, the substrate 11 has one surface formed into a flat surface 17 onto which an insulation layer 18 is deposited with the resistor 12 deposited thereover. Finally, the connector pads 13 and 14 and leads 15 and 16 are laid down and the entire conductive film portions covered with an insulating and protective layer 18 (e.g., SiO).

As to detailed aspects, the substrate 11 is preferably constructed of high density alumina ($Al_2O_3$) and in a practical embodiment was finished to $0.140 \times 0.140 \times 0.0015$ inches, although other geometries may be used such as circular (FIG. 2). A major surface is ground and polished to form the flat, smooth surface 17 and thoroughly cleaned. The substrate 11 is then loaded onto a suitable deposition fixture which, in turn, is placed on a rotating substrate carrier and entered into a vacuum evaporation system (not shown). For the practice of this invention, the vacuum system includes four different deposition stations for depositing, respectively, insulation layer 18, resistor 12, cover insulating layer 19 and connector pads 13 and 14.

In process, the first step is the vapor deposition of silicon monoxide (SiO) onto the flat, polished substrate surface to form the insulation precoat 18. Then, the precoated substrate is moved to the next station where metallic nickel is vapor deposited via a suitable mask to provide a spiral-shaped or serpentine resistor 12 on the insulating layer 18. Next, the partially completed unit is moved to a further station where the connector pads 13 and 14 of gold or nickel alloy are deposited.

At this stage the partially completed sensors are removed from the vacuum system and vacuum annealed at 805° F. to effect both stabilization of grain structure and resistance value. In a practical construction of the invention the final annealed resistance of 12 was 1000 ohms at 70° F.

Gold leads 15 and 16 are then secured to the connection pads 13 and 14 (e.g., by resistance welding), after which the assembly is once more placed in the vacuum deposition chamber where it is overcoated with silicon monoxide to form the protective cover 19.

As a final matter, the completed temperature sensor is removed from the vacuum deposition chamber, cemented to a metal end cap, after which it is subjected to 400° F. for 48 hours to stabilize the resistor 12 further, and, as well, cure the cement used to secure the substrate and metal cap together.

As alternatives, the substrate may be constructed of beryllium oxide and the temperature sensitive resistor 12 of platinum.

In the practice of this invention, there is provided a thin-film resistance temperature sensor possessed of high accuracy, which is exceptionally rugged in construction and has the small size and weight advantages associated with thin-film construction.

I claim:

1. A deposited thin-film resistance temperature sensor, comprising:

a high-density alumina substrate having a flat polished surface;

a first silicon monoxide layer vapor deposited onto said substrate flat polished surface;

a sinuous length of evaporated nickel film deposited onto said first silicon monoxide layer;

first and second connector pads deposited onto said nickel film spaced from one another along the nickel film that amount necessary to define a predetermined magnitude of electrical resistance for said nickel film;

first and second gold leads respectively resistance welded to said first and second connector pads; and a second silicon monoxide layer vapor deposited over said nickel film and said connector pads leaving outer end portions of said gold leads exposed.

2. A deposited thin-film temperature sensor as in claim 1, in which the nickel film is annealed at approximately 805° F. to stabilize film resistance.

3. A method of making a thin-film temperature sensing device, comprising:

forming a flat polished surface on a high-density alumina substrate;

vapor depositing a film of silicon monoxide onto the flat polished surface of the substrate;

vapor depositing a spiral-shaped metallic nickel film onto the silicon monoxide film;

vapor depositing metallic connection pads onto said nickel film;

heating the substrate with silicon monoxide and metallic nickel films thereon to a temperature of 805° F. (429° C.) in a low gas pressure environment to effect stabilization of the nickel film grain structure and resistance value;

resistance welding a gold lead to each connection pad;

vapor depositing a silicon monoxide film over the nickel film and connection pads; and heating the assembly to 400° F. (204° C.) for approximately 48 hours to stabilize the resistance of the nickel film.

* * * * *